US009025993B2

(12) United States Patent
Iwasaki et al.

(10) Patent No.: US 9,025,993 B2
(45) Date of Patent: May 5, 2015

(54) CLEANING BRUSH, CHARGING DEVICE, AND IMAGE FORMING APPARATUS

(71) Applicant: Fuji Xerox Co., Ltd., Minato-ku, Tokyo (JP)

(72) Inventors: Jin Iwasaki, Kanagawa (JP); Hirotaka Tanaka, Kanagawa (JP); Ken Ozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/074,347

(22) Filed: Nov. 7, 2013

(65) Prior Publication Data

US 2014/0363194 A1 Dec. 11, 2014

(30) Foreign Application Priority Data

Jun. 11, 2013 (JP) ..... 2013-122574

(51) Int. Cl.
*G03G 15/02* (2006.01)

(52) U.S. Cl.
CPC ..... *G03G 15/0291* (2013.01)

(58) Field of Classification Search
USPC ..... 399/100
See application file for complete search history.

(56) References Cited

U.S. PATENT DOCUMENTS 5,923,940 A * 7/1999 Baldwin et al. ..... 399/353
6,044,244 A * 3/2000 Watanabe et al. ..... 399/313
6,167,229 A * 12/2000 Watanabe et al. ..... 399/313
7,826,787 B2 * 11/2010 Hatakeyama et al. ..... 399/346
2008/0063447 A1 * 3/2008 Kawahara et al. ..... 399/346
2008/0304866 A1 * 12/2008 Takenaka et al. ..... 399/175

FOREIGN PATENT DOCUMENTS

JP 2003-271032 A 9/2003
JP 2008-112083 A 5/2008
JP 2011-128465 A 6/2011

OTHER PUBLICATIONS

Japanese Unexamined Patent Application Publication No. 2003-271032.
Japanese Unexamined Patent Application Publication No. 2011-128465.
Japanese Unexamined Patent Application Publication No. 2008-112083.

* cited by examiner

*Primary Examiner* — W B Perkey
*Assistant Examiner* — Linda B Smith
(74) *Attorney, Agent, or Firm* — Sughrue Mion, PLLC

(57) ABSTRACT

A cleaning brush includes bristles that have ends which come into contact with an object to be cleaned having irregularities on a surface thereof, and a brush base on which the bristles are arranged. The bristles include first bristles and second bristles. The first bristles have a thickness too great to reach bottoms of recessed portions of the irregularities on the surface of the object to be cleaned. The second bristles have a thickness small enough to reach the bottoms of the recessed portions of the irregularities on the surface of the object to be cleaned.

11 Claims, 6 Drawing Sheets

FIG. 7
| | Rv [μm] | dv [μm] |
|---|---|---|
| CHARGING ROLLER A | 2.3 | 15 |
| CHARGING ROLLER B | 3.8 | 38 |
| CHARGING ROLLER C | 5.7 | 50.1 |
| CHARGING ROLLER D | 8.2 | 76 |
| | Ry(= Rp + Rv) [μm] | Sm(= dp + dv) [μm] |
|---|---|---|
| CHARGING ROLLER A | 5 | 38.2 |
| CHARGING ROLLER B | 8 | 72.3 |
| CHARGING ROLLER C | 11.5 | 104.3 |
| CHARGING ROLLER D | 17.8 | 141.2 |
FIG. 8A
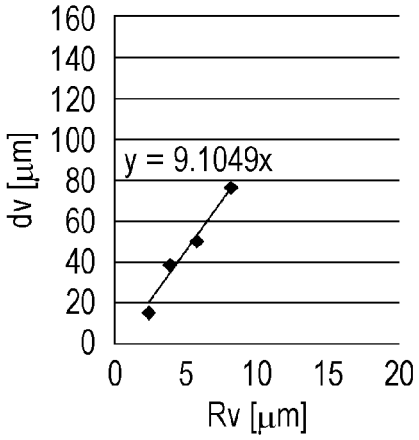
FIG. 8B
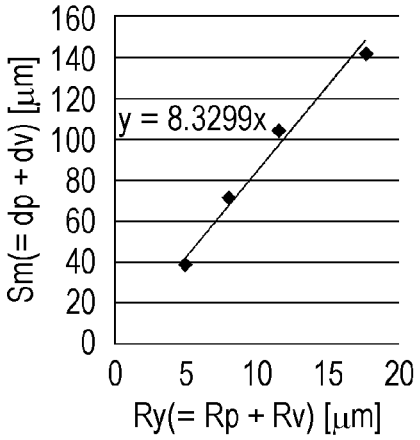

CLEANING BRUSH, CHARGING DEVICE, AND IMAGE FORMING APPARATUS

CROSS-REFERENCE TO RELATED APPLICATIONS

This application is based on and claims priority under 35 USC 119 from Japanese Patent Application No. 2013-122574 filed Jun. 11, 2013.

BACKGROUND (i) Technical Field

The present invention relates to a cleaning brush that removes particles and the like attached to an object to be cleaned. The present invention also relates to a charging device and an image forming apparatus that use the cleaning brush.

(ii) Related Art

Apparatuses that use particles or treat particles often use a cleaning brush so as to remove adhering particles. For example, in an image forming apparatus of an electrophotographic system or an electrostatic recording system that uses particulate developer, toner and external additives contained in the developer adhere to an image carrier having a peripheral surface on which a toner image is formed, an intermediate transfer body onto which the formed toner image is temporarily transferred, a charging device that is disposed in contact with the image carrier so as to charge the surface of the image carrier, and the like. In order to remove these particles, a cleaning brush is used.

SUMMARY

According to an aspect of the invention, there is provided a cleaning brush including bristles that have ends which come into contact with an object to be cleaned having irregularities on a surface thereof, and a brush base on which the bristles are arranged. The bristles include first bristles and second bristles. The first bristles have a thickness too great to reach bottoms of recessed portions of the irregularities on the surface of the object to be cleaned. The second bristles have a thickness small enough to reach the bottoms of the recessed portions of the irregularities on the surface of the object to be cleaned.

BRIEF DESCRIPTION OF THE DRAWINGS

Exemplary embodiments of the present invention will be described in detail based on the following figures, wherein:

FIG. 7 is a table showing measurement data of surface irregularities of four charging rollers having surface layers to which different amount of fillers having different particle diameters are respectively added;

FIG. 8A is a graph showing the relationship between the depth and the planar size of the recessed portion on the surface of the charging roller;

FIG. 8B is a graph showing the relationship between the height from the peak of the raised portion to the bottom of the recessed portion and the planar size of a pair of raised and recessed portions (a single cycle of a pair of raised and recessed portions);

DETAILED DESCRIPTION

Hereinafter, exemplary embodiments of the present invention will be described with reference to the accompanying drawings.

Figure 1:
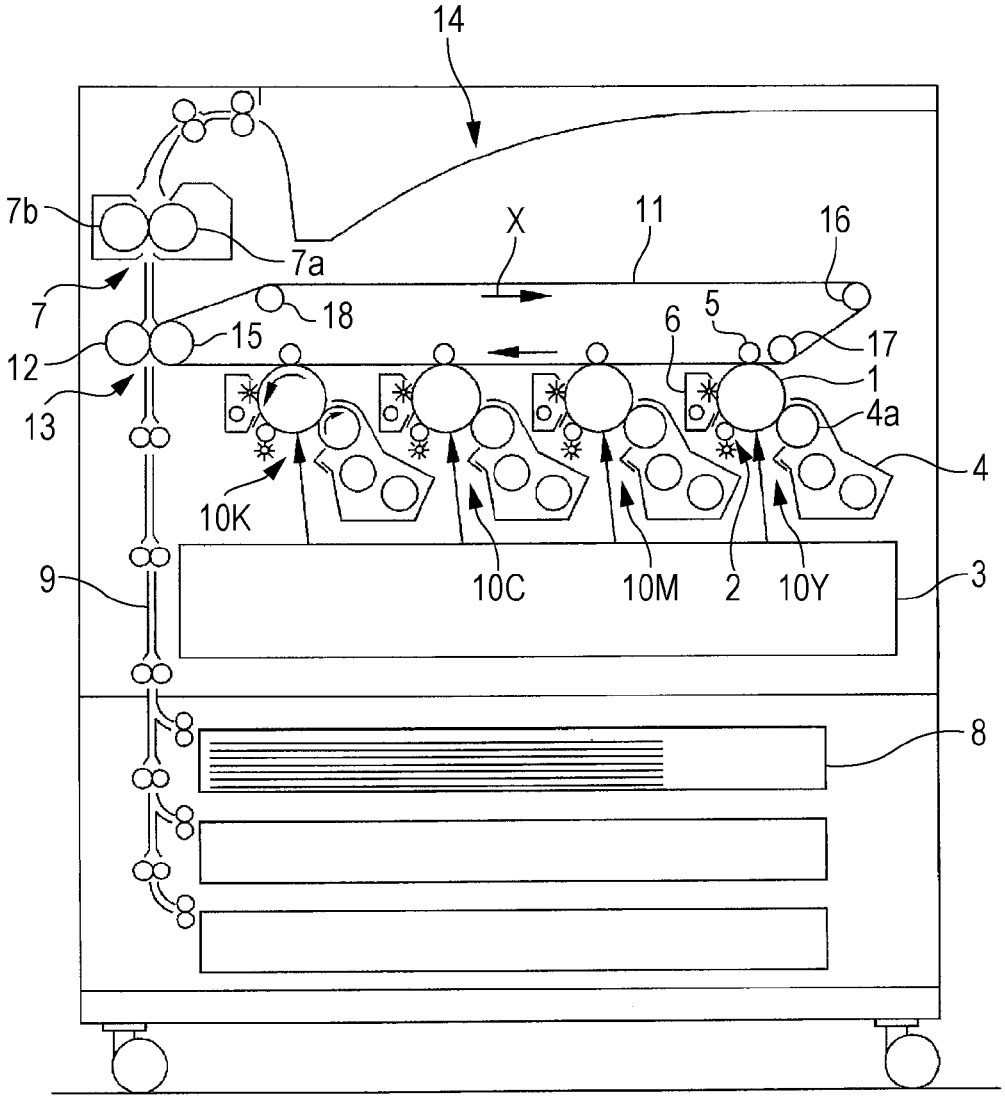
FIG. 1 is a schematic configuration diagram of an image forming apparatus according to an exemplary embodiment of the present invention.

FIG. 1 is a schematic configuration diagram of an image forming apparatus according to an exemplary embodiment of the present invention.

The image forming apparatus forms a color image using four color toners. The image forming apparatus includes electrophotographic image forming units 10Y, 10M, 10C, and 10K that output images of yellow (Y), magenta (M), cyan (C), and black (K), respectively, and an intermediate transfer belt 11 facing the image forming units 10Y, 10M, 10C, and 10K.

The intermediate transfer belt 11 is an endless film member formed of multiple layers, and is supported by an opposed roller 15 that is rotated, an adjusting roller 16 that adjusts the position of the intermediate transfer belt 11 in the width direction, and two support rollers 17 and 18. When the opposed roller 15 is driven, the peripheral surface of the intermediate transfer belt 11 rotates in the direction indicated by the arrow X.

The image forming unit 10Y that forms an yellow toner image, the image forming unit 10M that forms a magenta toner image, the image forming unit 10C that forms a cyan toner image, the image forming unit 10K that forms a black toner image are arranged in this order from the upstream of the rotating direction of the intermediate transfer belt 11. A second transfer roller 12 that performs a second transfer is arranged at the downstream side thereof so as to be in contact with the intermediate transfer belt 11 and to face the opposed roller 15.

A recording sheet serving as a recording medium is fed from a recording sheet storing unit 8 through a transport path 9 to a second transfer position 13 where the second transfer roller 12 faces the intermediate transfer belt 11. A fixing device 7 is disposed downstream of the second transfer position 13 in the transport channel of the recording sheet. The fixing device 7 applies heat and pressure to the toner image so as to fix the toner image onto the recording sheet.

A discharged paper holding unit 14 is disposed at the further downstream side. Recording sheets having toner images fixed thereon are stacked and held in the discharged paper holding unit 14.

Each image forming unit 10 includes a photoconductor drum 1 having a surface on which an electrostatic latent image is formed and which serves as an image carrier. A charging device 2, a developing device 4, a first transfer roller 5, and a cleaning device 6 are arranged around the photoconductor drum 1. The charging device 2 charges the surface of the photoconductor drum 1. The developing device 4 forms a toner image by selectively applying toner to the electrostatic latent image formed on the photoconductor drum 1. The first transfer roller 5 performs a first transfer so as to transfer the toner image formed on the photoconductor drum 1 onto the intermediate transfer belt 11. The cleaning device 6 removes the toner remaining on the photoconductor drum 1 after the first transfer. An exposure device 3 that produces an image light on the basis of an image signal is provided for each photoconductor drum 1. The exposure device 3 irradiates the photoconductor drum 1 in a charged state with the image light, and thereby writes an electrostatic latent image on the charged photoconductor drum 1.

The photoconductor drum 1 is formed by stacking a photosensitive layer on the peripheral surface of a conductive metal base. The peripheral surface of the photoconductor drum 1 rotates. The metal base is electrically grounded. The photosensitive layer is a functional separation type layer in which a charge generating layer and a charge transport layer are sequentially stacked. Thus, when the exposure device 3 irradiates the photosensitive layer with a laser beam, the charge potential in the irradiated portion decreases.

The charging device 2 includes a charging roller 21 that is disposed in contact with the peripheral surface of the photoconductor drum 1, which is an object to be charged. The charging device 2 applies a voltage to the charging roller 21 so as to cause electric discharge in a small gap between the charging roller 21 and the photoconductor drum 1, and thereby charges the surface of the photoconductor drum 1. The charging device 2 will be described below in greater detail.

The exposure device 3 scans the peripheral surface of the photoconductor drum 1 with a laser beam that turns on and off in accordance with an image signal. At the same time, the peripheral surface of the photoconductor drum 1 rotates. Thus, the laser beam is irradiated on the surface of the photoconductor drum 1 so as to correspond to an image to be formed. Then, the potential of the portion irradiated with the laser beam decreases, so that an electrostatic latent image is formed.

The developing device 4 uses two-component developer containing toner and magnetic carrier. The developing device 4 includes a developing roller 4*a* disposed at a position facing the photoconductor drum 1. The toner is applied from the developer held on the peripheral surface of the developing roller 4*a* to the photoconductor drum 1. Thus, a visible toner image is formed.

The first transfer roller 5 includes a metal core with its outer surface covered with a rubber material to which conductive particles are added. The first transfer roller 5 is disposed on the back side of the intermediate transfer belt 11 at a position facing the photoconductor drum 1 in each of the image forming units 10Y, 10M, 10C, and 10K. A bias voltage for a first transfer is applied to the first transfer roller 5, so that an electric field for transfer is formed between the first transfer roller 5 and the photoconductor drum 1. Thus, at a first transfer position where the photoconductor drum 1 and the first transfer roller 5 face each other, the toner image on the photoconductor drum 1 is electrostatically transferred onto the intermediate transfer belt 11 passing therethrough.

The cleaning device 6 is disposed so as to face the peripheral surface of the photoconductor drum 1. The cleaning device 6 includes a cleaning blade that is supported so as to be in contact with the peripheral surface of the photoconductor drum 1. The edge at the end of the cleaning blade is in contact with the surface of the photoconductor drum 1, so that the toner and the like remaining on the photoconductor drum 1 are scraped off and removed after the first transfer.

The second transfer roller 12 is pressed against the opposed roller 15 with the intermediate transfer belt 11 interposed therebetween, and is rotated by the rotation of the opposed roller 15. Then, a second transfer voltage is applied between the second transfer roller 12 and the opposed roller 15, so that an electric field for transfer is formed. Accordingly, when a recording sheet is fed between the second transfer roller 12 and the intermediate transfer belt 11, the recording sheet is nipped and transported, and the toner image on the intermediate transfer belt 11 is transferred onto the recording sheet by the action of the electric field.

The fixing device 7 includes a heating roller 7*a* having a heat source therein, and a pressure roller 7*b* that is brought into pressure contact with the heating roller 7*a*. The heating roller 7*a* and the pressure roller 7*b* form a contact nip part. The recording sheet having the toner image transferred thereon is fed to the nip part, and is heated and pressed between the rotating heating roller 7*a* and pressure roller 7*b*. Thus, the toner image is fixed on the recording sheet.

Figure 2:
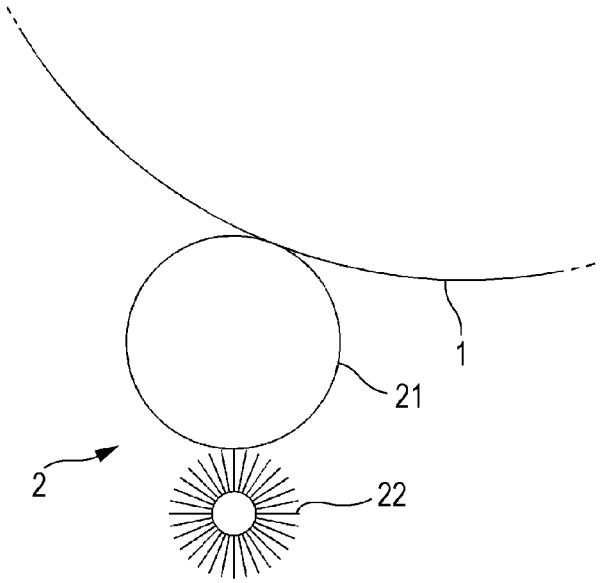
FIG. 2 is a schematic configuration diagram of a charging device that may be used in the image forming apparatus of FIG. 1 according to an exemplary embodiment.

FIG. 2 is a schematic cross-sectional diagram illustrating the charging device 2.

The charging device 2 includes the charging roller 21 that is disposed in contact with the peripheral surface of the photoconductor drum 1 and that is configured such that a charging voltage is applied between the charging roller 21 and the photoconductor drum 1, and a cleaning brush 22 that is disposed so as to be in contact with the surface of the charging roller 21.

Figure 3:
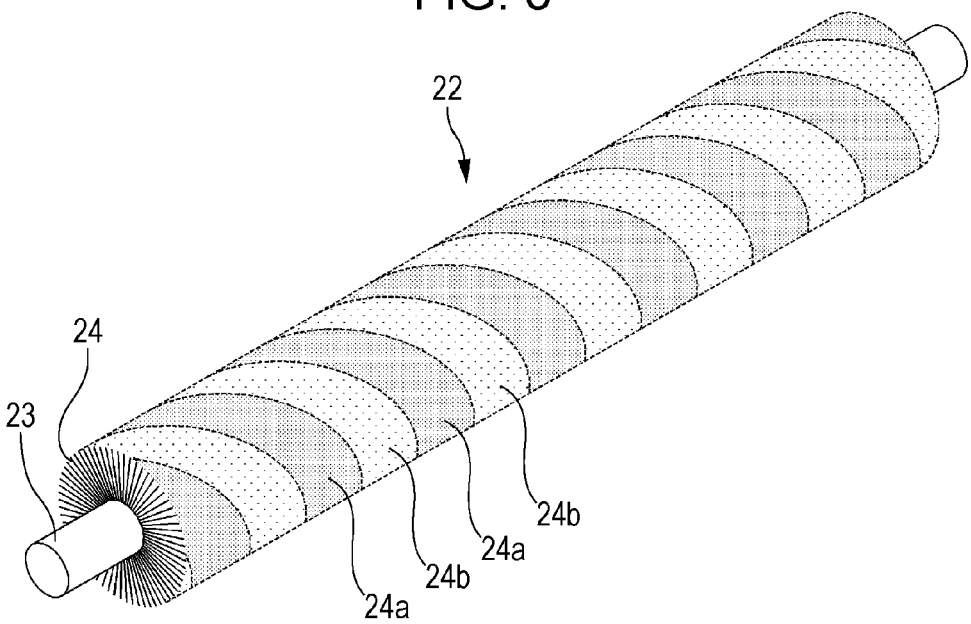
FIG. 3 is a schematic configuration diagram of a cleaning brush that may be used in the charging device of FIG. 2 according to an exemplary embodiment.

As illustrated in FIG. 3, the cleaning brush 22 includes a support shaft 23 serving as a brush base and having a circular cross-sectional shape. Bristles 24 are arranged on the peripheral surface of the support shaft 23. The bristles 24 include first-type bristles 24*a* having a greater diameter and second-type bristles 24*b* having a diameter less than that of the first-type bristles 24*a*. The first-type bristles 24*a* and the second-type bristles 24*b* are arranged in different regions. These regions are adjacent to each other and extend helically around the support shaft 23.

Both the first and second types of the bristles 24 are nylon fibers. The first-type bristles 24*a* have a denier of 40 (a diameter of 101 μm), and the second-type bristles 24*b* have a denier of 2 (a diameter of 16 μm).

Figure 4:
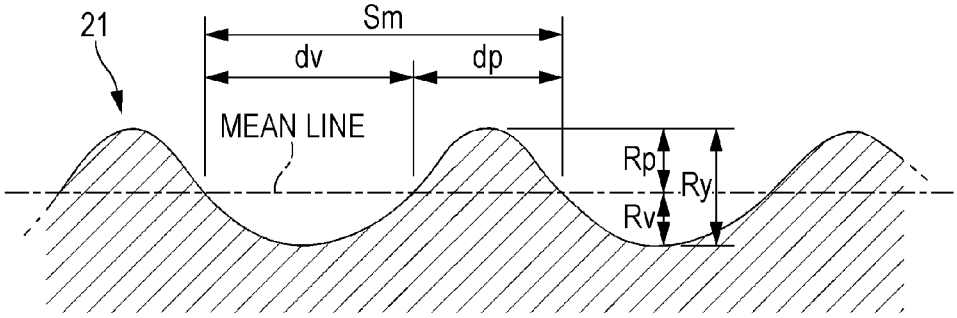
FIG. 4 is an enlarged cross-sectional view illustrating surface irregularities of a charging roller.

The charging roller 21 has, on its surface, a coating containing dispersed particulate filler. The filler produces irregularities as illustrated in FIG. 4. The particle diameter and the amount of the dispersed filler may be appropriately changed. Thus, the spacing between the irregularities, the heights of the irregularities, and the like may be changed. According to the actual measured values of the present exemplary embodiment, an average depth Rv from the mean line to the bottom of the recessed portions is 5.7 μm; an average height Ry from the peaks of the raised portions to the bottoms of the recessed portions is 11.5 μm; and an average length Sm of a pair of the raised and recessed portions is 104.3 μm. A width dv of the recessed portions on the mean line may be estimated by the following equation, and is 51.7 μm in the present exemplary embodiment.

$$dv = Sm \times (Rv/Ry) \quad (1)$$

Note that Ry=Rp+Rv, in which Rp is the average height from the mean line to the peak of the raised portions.

Further, Sm=dp+dv, in which dp is the width of the raised portion on the mean line.

In view of the irregularities of the charging roller 21 described above, the diameter of the first-type bristles 24*a* of the cleaning brush 22 is greater than the width dv of the recessed portions on the mean line, and the diameter of the second-type bristles 24*b* is less than the width dv of the recessed portions on the mean line.

Note that the mean line is set on the basis of a curve (a roughness curve) representing the cross-sectional shape of the surface irregularities of the charging roller 21 such that the cross-sectional area of the raised portions above the mean line is equal to the cross-sectional area of the recessed portions below the mean line.

Figure 5A:
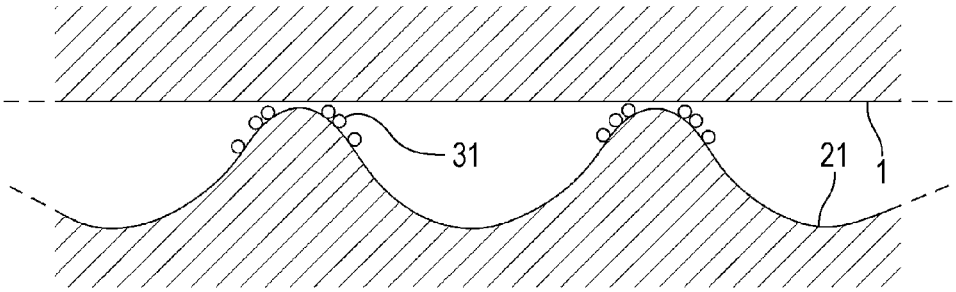
FIGS. 5A and 5B are enlarged cross-sectional views illustrating particles attached to the charging roller in contact with the surface of an image carrier.
Figure 5B:
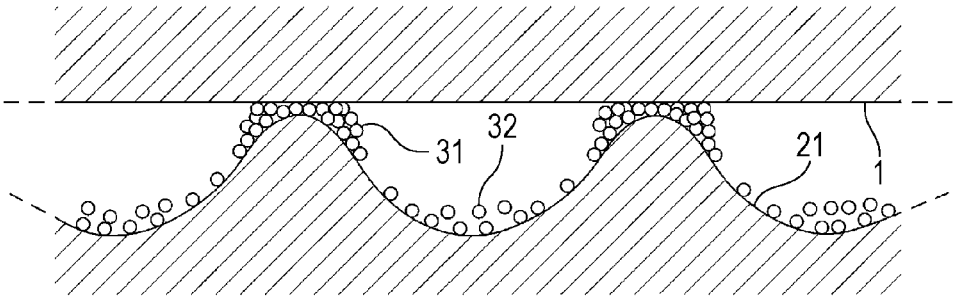

The charging roller 21 rotates in contact with the surface of the photoconductor drum 1, so that the raised portions are pressed against the surface of the photoconductor drum 1 as illustrated in FIG. 5A. If particles such as toner and external additives are attached to the surface of the photoconductor drum 1, the particles are transferred and adhere to the raised portions. When the raised portions on the surface of the charging roller 21 are pressed against the surface of the photoconductor drum 1, particles 31 attached around the raised portions are pressed against the raised portions and aggregated. If the particles 31 are not removed, the aggregate gradually grows and extends over a greater area as illustrated in FIG. 5B. On the other hand, the recessed portions do not come into direct contact with the surface of the photoconductor drum 1. However, particles that are scattered by being brought into contact with the raised portions and particles 32 that are pushed out to the sides from around the raised portions get into the recessed portions, so that the particles are loosely accumulated and remain therein.

In order to remove the particles 31 and 32 thus attached to the surface of the charging roller 21, the bristles 24 of the cleaning brush 22 clean the surface of the charging roller 21 in the following manner.

Figure 6A:
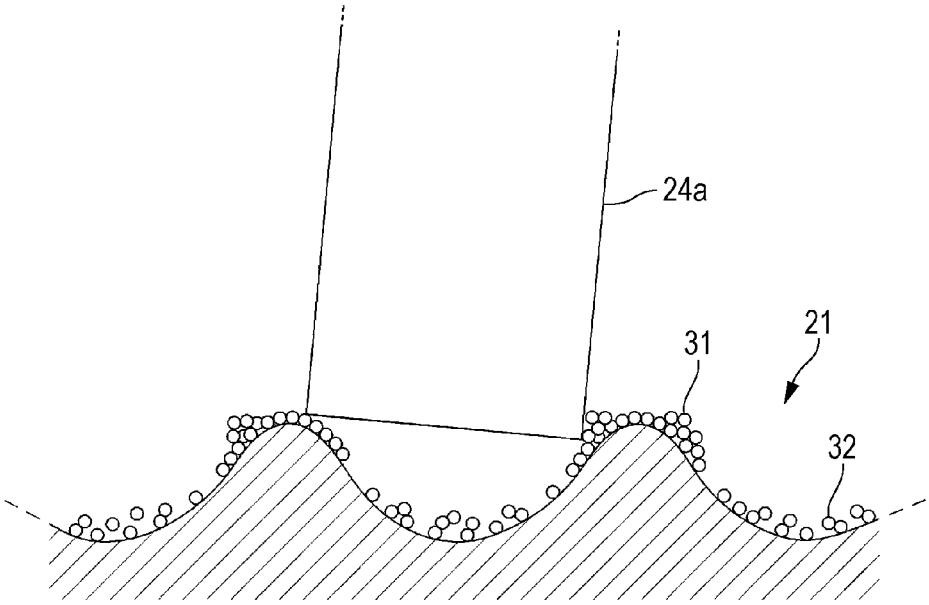
FIGS. 6A and 6B are schematic cross-sectional views illustrating how a bristle of the cleaning brush cleans the irregular surface of the charging roller.

The first-type bristles 24*a* have a diameter greater than the width dv of the recessed portions on the mean line, and therefore are not able to reach the bottoms of the recessed portions as illustrated in FIG. 6A. Accordingly, the first-type bristles 24*a* come into contact with the raised portions, and scrape off and remove the particles 31 attached around the raised portions. The first-type bristles 24*a* have a greater diameter and a high rigidity. Therefore, the first-type bristles 24*a* may firmly scrape off the particles around the raised portions, and thus effectively remove the particles 31 even if the particles 31 are pressed and aggregated on the raised portions of the charging roller 21. Further, the first-type bristles 24*a* do not reach the bottoms of the recessed portions. This reduces the risk that the first-type bristles 24*a* strongly rub the particles 32, which are loosely accumulated near the bottoms of the recessed portions, on the bottoms of the recessed portions, and that it becomes difficult to scrape off the particles 32.

Figure 6B:
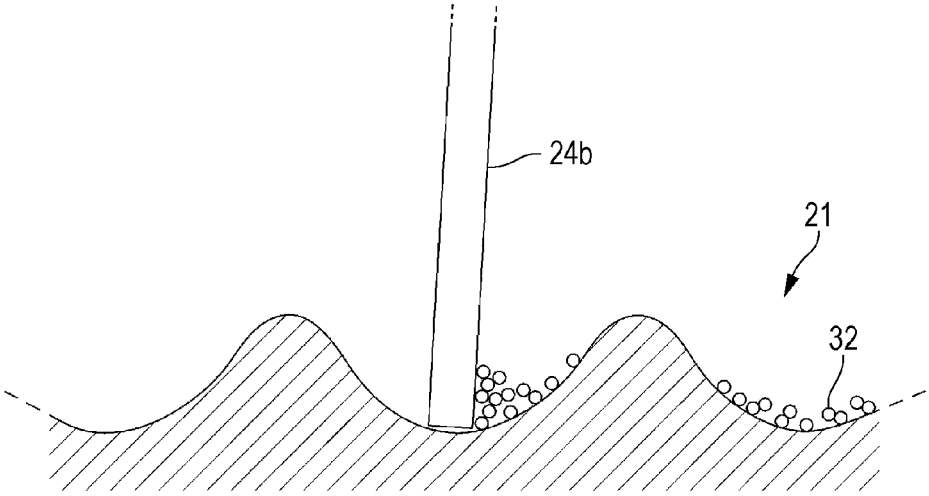

On the other hand, the second-type bristles 24*b* have a diameter less than the width dv of the recessed portions on the mean line. Therefore, the second-type bristles 24*b* may reach the bottoms of the recessed portions, and scrape off and remove the particles 32 accumulated in the recessed portions as illustrated in FIG. 6B. The second-type bristles 24*b* have a smaller diameter and a lower rigidity. However, the particles 32 in the recessed portions are loosely accumulated and therefore may be scraped off and removed by the second-type bristles 24*b* having a smaller thickness. In the case where bristles have high rigidity, the particles 32 are strongly rubbed on the recessed portions of the charging roller 21 and may become hard to be scraped off. On the other hand, the second-type bristles 24*b* that reach the bottoms of the recessed portions have a lower rigidity, and therefore are prevented from strongly rubbing the particles 32 on the recessed portions.

The cleaning brush 22 is divided into a region where the first-type bristles 24*a* are arranged and a region where the second-type bristles 24*b* are arranged such that the both types of bristles 24 come into contact with the entire area that is needed to be cleaned by the charging roller 21. Then, the surface of the charging roller 21 is repeatedly and alternately cleaned by the first-type bristles 24*a* and the second-type bristles 24*b*. In the case where the first-type bristles 24*a* having a greater diameter and the second-type bristles 24*b* having a smaller diameter are mixed, when cleaning the recessed portions, the second-type bristles 24*b* having a lower rigidity come into contact with the first-type bristles 24*a* having a higher rigidity, so that the motion of the second-type bristles 24*b* is limited. Thus, the second-type bristles 24*b* might become unable to flexibly sweep the particles out of the recessed regions. On the other hand, in the case of the cleaning brush illustrated in FIG. 3, since the first-type bristles 24*a* and the second-type bristles 24*b* are arranged in separate regions, these different types of bristles may clean the raised regions and recessed regions on the surface of the charging roller 21 by utilizing their characteristics.

As mentioned above, in the present exemplary embodiment, in order to set the diameters of the first-type bristles 24*a* and the second-type bristles 24*b* such that the first-type bristles 24*a* do not reach the bottoms of the recessed portions and the second-type bristles 24*b* reach the bottoms of the recessed portions, the diameter of the first-type bristles 24*a* is set to be greater than the average width dv of the recessed portions on the mean line of the surface roughness curve of the charging roller 21, and the diameter of the second-type bristles 24*b* is set to be less than the average width dv of the recessed portions on the mean line. Although the average width dv of the recessed portions on the mean line serving as a reference for setting the diameter of the bristles may be calculated from the shape of the curve measured by directly measuring the shape of the surface irregularities of the charging roller 21, the average width dv may be estimated by the above equation (1) for the following grounds.

Figure 9:
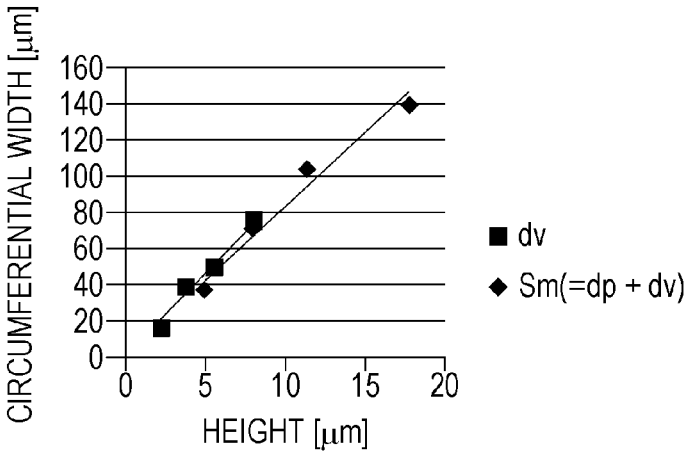
FIG. 9 is a graph showing both the relationship between the depth and the planar size of the recessed portion on the surface of the charging roller and the relationship between the height from the peak of the raised portion to the bottom of the recessed portion and the planar size of a pair of raised and recessed portions (a single cycle of a pair of raised and recessed portions)

Four charging rollers having surface layers to which different amount of fillers having different particle diameters are respectively added are prepared. An average depth Rv (μm) from the mean line of the surface irregularities to the bottoms of the recessed portions, a width dv (μm) of the recessed portions on the mean line, an average height Ry (μm) from the peaks of the raised portions to the bottoms of the recessed portions, and an average length Sm (μm) of a pair of the raised and recessed portions are measured. FIG. 7 shows the obtained results. FIGS. 8A and 8B show the relationship between the average depth Rv (μm) from the mean line to the bottoms of the recessed portions and the width dv (μm) of the recessed portions on the mean line and the relationship between the average height Ry (μm) from the peaks of the raised portions to the bottoms of the recessed portions and the average length Sm (μm) of a pair of the raised and recessed portions, respectively, that are calculated on the basis of the obtained results. In FIG. 9, these two graphs are superimposed. The coefficients representing the respective relationships, or the gradients in FIGS. 8A and 8B, have little different, and thus may be regarded as having the same value α.

Accordingly, the relationship between the width dv (μm) of the recessed portions on the mean line and the average depth Rv (μm) from the mean line to the bottoms of the recessed portions may be expressed by the following equation.

$$dv=\alpha\times Rv \quad (2)$$

On the other hand, the relationship between the average length Sm (μm) of a pair of the raised and recessed portions and the average height Ry (μm) from the peaks of the raised portions to the bottoms of the recessed portions may be expressed by the following equation.

$$Sm=\alpha\times Ry \quad (3)$$

When α is eliminated from the equations (2) and (3), the above equation (1) is obtained. Then, the width dv of the recessed portions on the mean line may be estimated by the obtained equation (1).

The cleaning brush 22, the charging device 2, and the image forming apparatus are exemplary embodiments of the prevent invention. The present invention is not limited to the exemplary embodiments described above, and may be implemented as other embodiments without departing from the scope of the present invention.

For example, the layout of the image forming units, intermediate transfer body, fixing device, and the like in the image forming apparatus may be appropriately designed. The image forming apparatus may be one that does not include an intermediate transfer body, or may be one that forms a single color image.

The cleaning brush may be one that has a region where only the first-type bristles are arranged and a region where only the second-type bristles are arranged, or may be one in which the first-type bristles and the second-type bristles are mixed.

Figure 10:
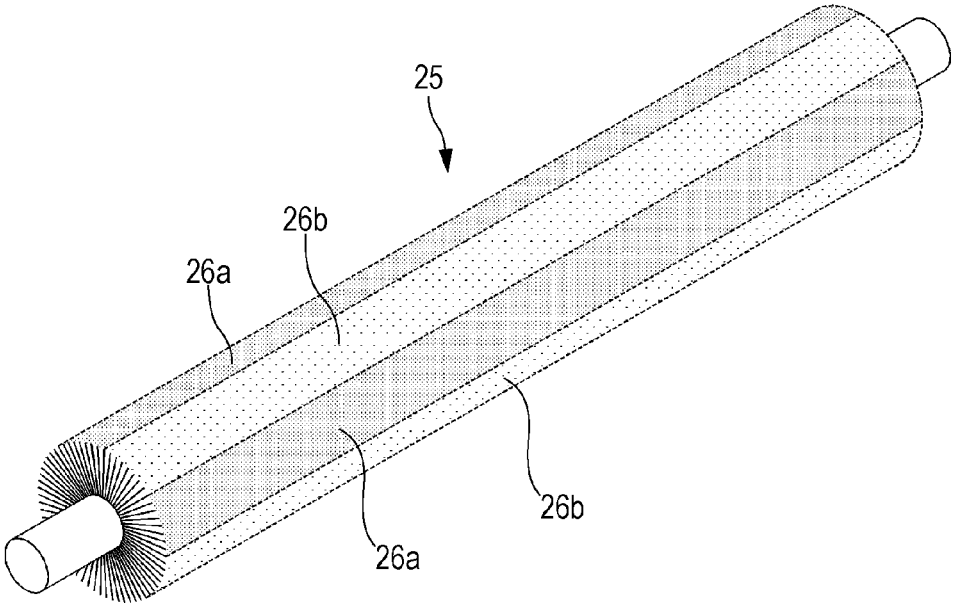
FIG. 10 is a schematic perspective view of another example of the cleaning brush according to the exemplary embodiment of the present invention.

The region where only the first-type bristles are arranged and the region where only the second-type bristles are arranged may be regions that helically extend as illustrated in FIG. 3. Alternatively, as illustrated in a cleaning brush 25 of FIG. 10, regions where only first-type bristles 26*a* are arranged and regions where only second-type bristles 26*b* are arranged may be alternately arranged in the circumferential direction.

The bristles are not limited to nylon fibers, and fibers made of various other materials may be appropriately used. Further, fibers made of different materials may be used for the first-type bristles and the second-type bristles.

The cross-sectional shape of the bristles is not limited to a circle, but may be an ellipse, an oval, a polygon, or other shapes.

The first-type bristles and the second-type bristles may be cut to the same length, or may be cut to different lengths. Further, the lengths of the first-type bristles may differ from each other, and the lengths of the second-type bristles may differ from each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning brush comprising:

bristles configured to come into contact with an object having irregularities on a surface thereof and configured to remove toner from the object; and a brush base on which the bristles are arranged, wherein the bristles comprises:

first bristles; and second bristles, wherein the first bristles have a first diameter too great to reach bottoms of recessed portions of the irregularities on the surface of the object; and wherein the second bristles have a second diameter small enough to reach the bottoms of the recessed portions of the irregularities on the surface of the object.

2. The cleaning brush according to claim 1;

wherein the brush base comprises:

a first region where only the first bristles are arranged, and a second region where only the second bristles are arranged.

3. The cleaning brush according to claim 1, wherein a maximum diameter of the first bristles, $d_a$, and a maximum diameter of the second bristles, $d_b$, satisfy an expression $d_a>S_m\times R_v/R_y>d_b$, in which $R_v$ is an average depth from a mean line of a roughness curve to the bottoms of the recessed portions, the roughness curve representing a cross-sectional shape of the surface of the object to be cleaned; $R_y$ is an average height from peaks of raised portions to the bottoms of the recessed portions; and $S_m$ is an average length of a pair of the raised and recessed portions.

4. The cleaning brush according to claim 2, wherein the first region where only the first bristles are arranged and the second region where only the second bristles are arranged extend helically around the brush base having a shaft shape.

5. The cleaning brush according to claim 2, wherein the first region where only the first bristles are arranged and the second region where only the second bristles are arranged extend in an axial direction of the brush base having a shaft shape, and are alternately formed in a circumferential direction thereof.

6. A charging device comprising:

a charging roller disposed in contact with a surface of an image carrier, on which an electrostatic latent image is to be formed, so as to charge the surface of the image carrier; and the cleaning brush of claim 1 that is supported such that bristles thereof are in contact with a surface of the charging roller, and that cleans the surface of the charging roller.

7. An image forming apparatus comprising:

an image carrier having a peripheral surface on which an electrostatic latent image is to be formed;

the charging device of claim 6 that is disposed in contact with the peripheral surface of the image carrier so as to charge the peripheral surface;

an exposure device configured to form the electrostatic latent image by irradiating the image carrier with an image light;

a developing device configured to develop the electrostatic latent image by applying toner to the electrostatic latent image;

a transferring unit configured to transfer a toner image formed by the development on the image carrier onto a recording medium; and a fixing unit configured to fix the toner image transferred on the recording medium onto the recording medium.

8. The cleaning brush according to claim 1, wherein the first and second bristles are made of same material.

9. The cleaning brush according to claim 8, wherein the first and second bristles are nylon fibers.

10. The cleaning brush according to claim 8, wherein the first bristles have a denier of 40, and the second bristles have a denier of 2.

11. The cleaning brush according to claim 2, wherein the first bristles in the first region include at least two bristles neighbored in the longitudinal direction of the cleaning brush in the first region.

* * * * *